US006926772B2

(12) United States Patent
Leonard

(10) Patent No.: US 6,926,772 B2
(45) Date of Patent: Aug. 9, 2005

(54) STRAND COATING DEVICE AND METHOD

(75) Inventor: William K. Leonard, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 473 days.

(21) Appl. No.: 10/087,301

(22) Filed: Feb. 27, 2002

(65) Prior Publication Data

US 2003/0161964 A1 Aug. 28, 2003

(51) Int. Cl.[7] ..... B05C 11/02

(52) U.S. Cl. ..... 118/110; 118/123; 118/234; 118/235; 118/325; 427/11; 427/359

(58) Field of Search ..... 118/110, 123, 118/124, 325, 420, 234, 235; 427/11, 178, 286, 346, 359

(56) References Cited

U.S. PATENT DOCUMENTS

| | | | | |
|---|---|---|---|---|
| 2,570,173 A | * | 10/1951 | Von Kohorn | 57/2 |
| 2,867,108 A | * | 1/1959 | Severni | 68/205 R |
| 3,194,210 A | | 7/1965 | Harris | |
| 3,266,461 A | | 8/1966 | Argue | |
| 3,589,854 A | | 6/1971 | Cobb et al. | |
| 3,749,055 A | | 7/1973 | Benson | |
| 4,020,194 A | | 4/1977 | McIntyre et al. | |
| 4,056,240 A | | 11/1977 | Gallini et al. | |
| 4,059,068 A | * | 11/1977 | Guillermin et al. | 118/420 |
| 4,192,663 A | | 3/1980 | Schmandt et al. | |
| 4,586,934 A | * | 5/1986 | Blalock et al. | 8/483 |
| 4,619,842 A | | 10/1986 | Moss et al. | |
| 4,877,306 A | | 10/1989 | Kar | |
| 5,034,250 A | | 7/1991 | Guertin | |
| 5,259,743 A | * | 11/1993 | Glaser | 425/66 |
| 5,386,712 A | | 2/1995 | Haselwander | |
| 5,449,525 A | * | 9/1995 | Lundberg et al. | 427/128 |

FOREIGN PATENT DOCUMENTS

| | | |
|---|---|---|
| EP | 0 407 708 A | 1/1991 |
| FR | 2 464 843 | 12/1980 |
| FR | 2 717 505 | 9/1995 |
| GB | 2 280 391 A | 2/1995 |
| WO | WO 02/055220 A1 | 7/2002 |

* cited by examiner

*Primary Examiner*—Chris Fiorilla
*Assistant Examiner*—Michelle Acevedo Lazor
(74) *Attorney, Agent, or Firm*—John A. Burtis

(57) ABSTRACT

Continuous void-free uniform coatings are formed on filamentous articles by applying a voided or otherwise substantially uneven coating to at least some of the exposed portion of a filamentous article or to a rotating substrate. The filamentous article or substrate is passed through an improvement station containing a plurality of coating-wetted rolls that contact and re-contact the wet coating at different positions along the length of the filamentous article or rotating substrate, wherein the periods of the rolls improve the uniformity of the coating. For coatings applied to a rotating substrate, the uniform wet coating is transferred to the filamentous article. The final coating can be very thin, very uniform and completely or substantially void-free. The coating improvement can be quickly and easily obtained using low cost equipment.

21 Claims, 5 Drawing Sheets

STRAND COATING DEVICE AND METHOD

FIELD OF THE INVENTION

This invention relates to devices and methods for coating strands or other filamentous articles.

BACKGROUND

There are many known methods and devices for applying liquid coatings to strands or other filamentous articles. For example, U.S. Pat. Nos. 3,194,210 (Harris) and 3,266,461 (Argue) describe wire coating devices. U.S. Pat. Nos. 3,589,854 (Cobb et al.); 3,749,055 (Benson); 4,056,240 (Gallini et al.); 5,034,250 (Guertin); 5,259,743 (Glaser) and 5,386,712 (Haselwander) and French Patent No. 2,717,505 (Mottet) describe yarn coating devices. U.S. Pat. No. 4,192,663 (Schmandt et al.) and French Patent Application No. 2 454 843 (Gouronnec et al.) describe a glass fiber coating devices, and U.S. Pat. No. 4,619,842 (Moss et al.) describes a glass fiber marking apparatus.

SUMMARY OF THE INVENTION

There are a number of strand coating devices and methods that can be used to form thick coatings on filamentous articles (e.g., wires, cables, glass fibers, threads, yarns and the like). Typically, a thick excess of coating liquid is applied to the entire exposed surface of the filamentous article, followed by removal of the excess coating material using a pad, roll or other device so that a desired final coating thickness can be obtained. These devices work well in non-precision applications. However, in general it is much more difficult to form very thin coatings on filamentous articles, especially when a highly uniform coating thickness is sought, when the coating is viscous or contains air bubbles, or when the coating operation is desired to be conducted at high speeds.

The present invention provides, in one aspect, a method for coating a filamentous article comprising applying a voided or otherwise substantially uneven coating to at least some of the exposed portion of a filamentous article and passing the substantially unevenly-coated filamentous article through an improvement station comprising a plurality of coating-wetted rolls that contact and re-contact the wet coating at different positions along the length of the filamentous article, wherein the periods of the rolls improve the uniformity of the coating.

In another aspect, the invention provides a method for coating a filamentous article comprising applying a voided or otherwise substantially uneven coating to a rotating substrate, contacting the coating with a plurality of coating-wetted rolls that contact and re-contact the coating at different positions around the circumference of the rotating substrate, and transferring the coating to the filamentous article.

The substantially uneven coating can conveniently be applied by dripping the coating liquid onto a portion of the filamentous article, onto one or more of the rolls, or onto the rotating substrate. In a conventional coating process, the application of an uneven coating would be avoided, and corrective steps might be taken so that the initially-applied coating would cover the entire exposed surface of the filamentous article as uniformly as possible. However, for a given average coating weight it is in fact easier to apply a voided or otherwise substantially uneven coating than to apply a high-quality, uniform thickness coating. If such a substantially uneven coating is applied and then passed through an improvement station of the invention, the coating uniformity is improved sufficiently so that the final coating can be very thin with very uniform thickness, and completely or substantially void-free. The present invention enables very precise metering of the mass of coating liquid per unit length of the filamentous article.

The invention also provides devices for carrying out the methods of the invention. In one aspect, the invention provides a device comprising a coating station that directly or indirectly applies a substantially uneven coating to at least some of the exposed portion of a filamentous article and an improvement station comprising two or more rotating rolls that periodically contact and re-contact the wet coating at different positions along the length of the filamentous article, wherein the periods of the rolls improve the uniformity of the coating.

In another aspect, the invention provides a device comprising a coating station that applies a substantially uneven coating to a rotating substrate, an improvement station comprising two or more rotating rolls that periodically contact and re-contact the wet coating at different positions along the length of the rotating substrate whereby the coating becomes more uniform, and a transfer station for transferring the resulting more uniform coating to the filamentous article.

The methods and devices of the invention facilitate the formation of continuous void-free, uniform and extremely thin coatings on filamentous articles using low-cost equipment.

DETAILED DESCRIPTION

The invention is especially useful for, but not limited to, coating moving endless (or essentially endless) filamentous articles. For brevity and unless the context requires otherwise, such a filamentous article will be referred to herein as a "strand". The strand can be dry (e.g., previously uncoated, or bearing a previously-applied hardened coating) or wet (e.g., bearing a previously-applied and unhardened wet coating). Typically the strand will have a circular cross-section. However, the invention is not limited to circular strands. The invention can also be used with strands having a noncircular cross-section, e.g., a square, rectangular, oblong or lobed cross-section.

The strand to be coated can have a smooth surface (e.g., as in a typical glass fiber or wire filament) or an uneven surface (e.g., as in a typical yarn or cable). The strand can be made from a non-absorbent material (e.g., as in a typical glass or wire filamentous article) or an absorbent material (e.g., as in a typical textile yarn). Preferably, the strand has a smooth surface and is made of a non-absorbent material.

The initially-applied coating is "substantially uneven". By this is meant that along a representative length (e.g., a 1 meter length) of the strand, the coating has voids or low spots whose minimum thickness is less than one-half the average coating thickness along that length.

Figure 1:
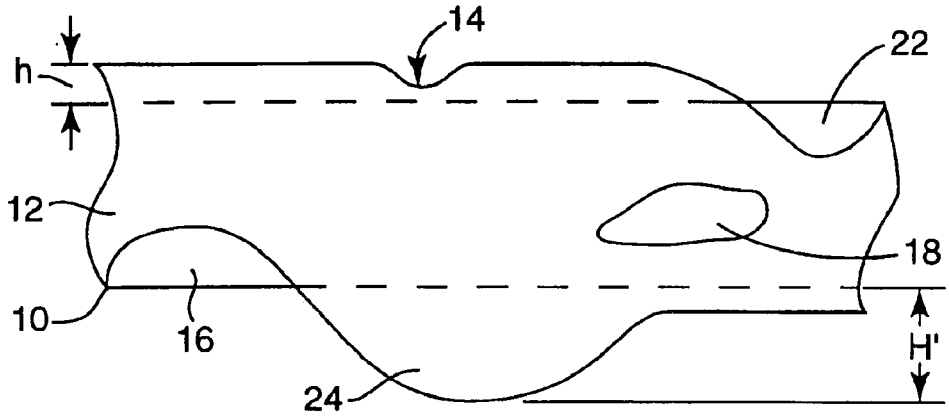
FIG. 1 is a schematic side view of a substantially uneven coating on a filamentous article.

Referring now to FIG. 1, a substantially uneven coating of liquid 12 having an average caliper or thickness h is present on strand 10. Coating 12 includes low spots such as low spot 14 having minimum thickness H, complete voids such as voids 16, 18 and 22 having zero thickness, and high spots such as high spot 24 having a maximum thickness H. The presence of such low spots, voids and high spots along a length of the coated strand might ordinarily be regarded as rendering that length of the coated strand defective and not useable.

Figure 2:
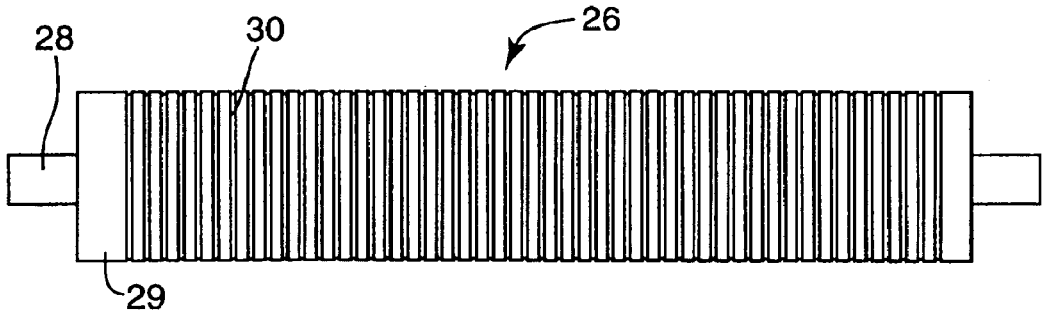
FIG. 2 is a side view of a grooved improvement station roll for use in a device of the invention.

FIG. 2 shows a side view of a grooved rubber roll 26 for use in an improvement station of the invention. Roll 26 is mounted on axle 28 equipped with bearings (not shown in FIG. 2) that permit roll 26 to rotate freely. The face 29 of roll 26 has a series of shallow grooves 30 whose width and depth preferably approximate the diameter of strand 10.

Figure 3:
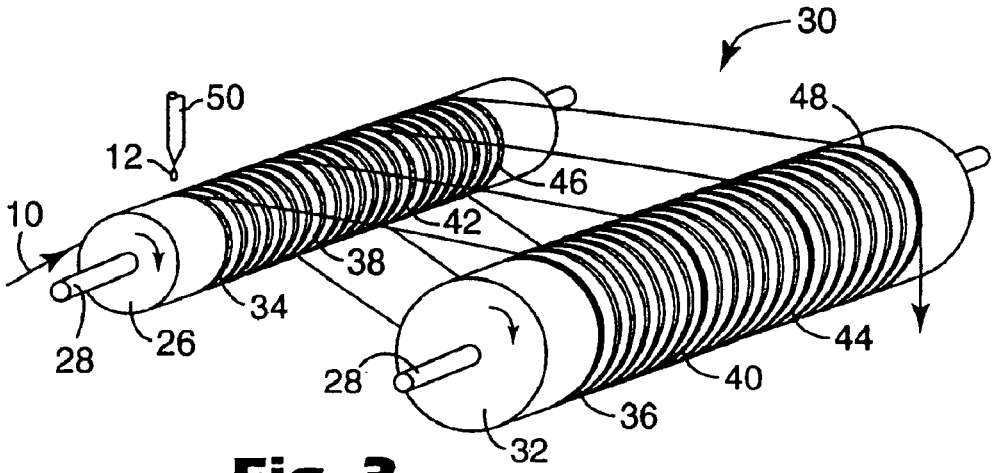
FIG. 3 is a perspective view of a device of the invention that employs a drip applicator and a set of improvement station rolls wrapped with multiple turns of a filamentous article.

FIG. 3 shows a perspective view of a coating device 30 that can be used to apply a substantially uneven coating to strand 10 and improve the uniformity of the applied coating so that low spots, voids and high spots are eliminated. Device 30 includes roll 26 of FIG. 2 and a second roll 32 whose diameter for the embodiment shown in FIG. 3 is approximately twice that of roll 26. If desired, roll 32 can have a larger, equal or smaller diameter in comparison to the diameter of roll 26. For the device setup shown in FIG. 3, strand 10 passes through grooves 34, 36, 38, 40, 42, 44, 46 and 48 located alternately on rolls 26 and 32, with the remaining grooves in rolls 26 and 32 being unused. The path is chosen so that the wet coated strand will come into physical contact with at least two rotating coating-wetted roll surfaces during operation of device 30. Coating liquid 12 is applied dropwise from dispenser 50 into groove 34 or onto strand 10 at a rate sufficient to produce a substantially uneven coating on strand 10. The applicator in effect applies the coating as a series of interrupted patches (which in the interest of brevity can be referred to as "stripes") into groove 34 or onto strand 10. Preferably the coating liquid is supplied at a metered or adjusted rate so that the average deposition rate per unit length of strand is controlled or otherwise regulated. Although in FIG. 3 coating liquid 12 is shown as being applied near the point at which strand 10 first reaches roll 26, coating liquid 12 can be applied to the groove 34 or the strand 10 at any other convenient upstream (or "up strand") location before strand 10 reaches roll 26, or at any other convenient downstream (or "down strand") location after strand 10 first contacts roll 26.

Rolls 26 and 32 preferably are undriven and will rotate (in response to the movement of the strand 10 and its friction with the grooves through which it passes) about axles 28. Following startup of the equipment and a few revolutions of rolls 26 and 32, the strand-contacting grooves 34, 36, 38, 40, 42, 44, 46 and 48 on rolls 26 and 32 become wet with coating liquid 12 transferred to and fro between strand 10 and the grooves. The circumferential profile of the liquid in the strand-contacting grooves initially will be very non-uniform and will consist of many high and low degrees of fill. After a few revolutions of the rolls 26 and 32, the circumferential profile of the liquid in the strand-contacting grooves will trend towards an equilibrium value as explained in more detail below. The remaining grooves in rolls 26 and 32 typically will remain dry, and thus the coating-wetted surfaces of rolls 26 and 32 typically will be limited to the strand-contacting grooves.

Figure 3A:
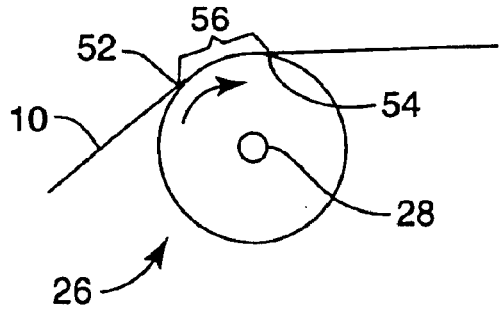
FIG. 3*a* is a side view of one of the improvement rolls in the device of FIG. 3.

Referring to FIG. 3*a*, strand 10 initially contacts roll 26 over contact region 56 between first entry point 52 and first liquid split point 54. At the split point, some coating liquid stays on strand 10 and some stays on roll 26 in groove 34 as roll 26 continues to rotate away from split point 54. The down strand average circumferential coating liquid mass per unit length on strand 10 will be proportionally mirrored in the coating liquid mass per unit length in groove 34 at the split point 54. The liquid split ratio between strand and groove may be 50/50 or may range from, for example, 90/10 to 10/90 depending upon factors such as the geometry of the groove, the wetted surface area for the strand and the groove, the nominal strand diameter and shape, and the strand's adsorption characteristics. However, this split ratio will trend towards an equilibrium value as the mass per unit length on the wire becomes more uniform. Following further revolution of roll 26, the liquid in groove 34 reenters contact region 56 at entry point 52. To a fixed observer, the flow rate of the liquid entering contact region 56 at entry point 52 will be the sum of the liquid entering on the strand 10 and the liquid entering on the roll 26. Roll 26 will place the split liquid at a new longitudinal position on strand 10. In this manner, portions of a liquid coating can be picked up from one strand position and placed back on the strand at another position and at another time. Both the rolls 26 and 32 produce this action. Thus when the coating-wetted surfaces of a plurality of rotating improvement station rolls such as rolls 26 and 32 are brought into contact with a wet liquid coating such as coating 12, excess coating or a portion of the excess such as at high spot 24 of FIG. 1 is picked off and placed at other positions on the strand. The placement positions can include positions having a deficiency of coating such as low spot 14 or voids 16, 18 and 22 of FIG. 1, and other positions having a lower than average coating caliper. If repeated a suitable number of times at appropriate placement periods, this pick-and-place action produces a much more uniform coating along the strand 10.

If coating liquid is intermittently placed into groove 34 or onto strand 10 at a suitably controlled flow rate, then a uniform mass per unit length and a continuous, void free coating is achieved on the strand after a suitable number of passes of the strand back and forth the between rolls 26 and 32. The degree and rate of improvement is facilitated when the diameters of rolls 26 and 32 are different, and especially when the roll periods are not related to one another as described in more detail below.

The use of a drip applicator such as applicator 50 enables the applied coating to be carefully premetered without waste or excess. Thus the final coating weight and thickness can be easily fine-tuned. The formation of uncontrolled rolling banks of coating liquid at the input or output side of the improvement rolls or dripping from a groove is thereby prevented or discouraged. If desired, a variety of other coating application techniques can be employed for intermittent application of coating liquid to the strand or to the improvement station roller(s), including small drop-producing devices and intermittent liquid dispensing devices. Examples of suitable small drop-producing devices include point source spray application nozzles such as airless, electrostatic, spinning disk and pneumatic spray nozzles. Line source atomization devices are also known and useful small drop-producing devices. The droplet size may range from very large (e.g., greater than 1 millimeter) to very small. The nozzle or nozzles can be oscillated back and forth. Examples of suitable intermittent liquid dispensing devices include suitably premetered or suitably intermittently applied wicks, pad applicators, brushes, needle applicators, roll coaters and the like. For example, the coating liquid can be applied to the strand using an oscillating needle applicator that sweeps back and forth over the strand, depositing coating liquid on the strand during a portion of each sweep and depositing excess coating liquid into a suitable catch-basin for recycling. The particulars of the chosen coating application device will in general not be critical, so long as the device is capable of providing the desired substantially uneven initially-applied coating. This helps reduce the overall cost of the devices of the invention, by avoiding the need for precision coating equipment.

The improvement rolls can if desired be brought into contact with coating 12 only upon appearance of a defect. Alternatively, the rolls can contact coating 12 whether or not a defect is present at the point of contact. Preferably, the rotating improvement station rolls remain in continuous contact with the coating, with any given portion of an improvement roll surface periodically contacting and re-contacting the coating at different positions along the length of the strand.

As shown in FIG. 3, four wraps of strand 10 about rolls 26 and 32 have been employed, for a total of four contact regions on each roll and eight contact regions throughout device 30. However, a lesser number (e.g., 3, 4, 5 or more) or a greater number (e.g., 13, 14, 15 or more) of contact regions can be used if desired. In general, a larger number of contact regions will provide better uniformity.

Figure 4:
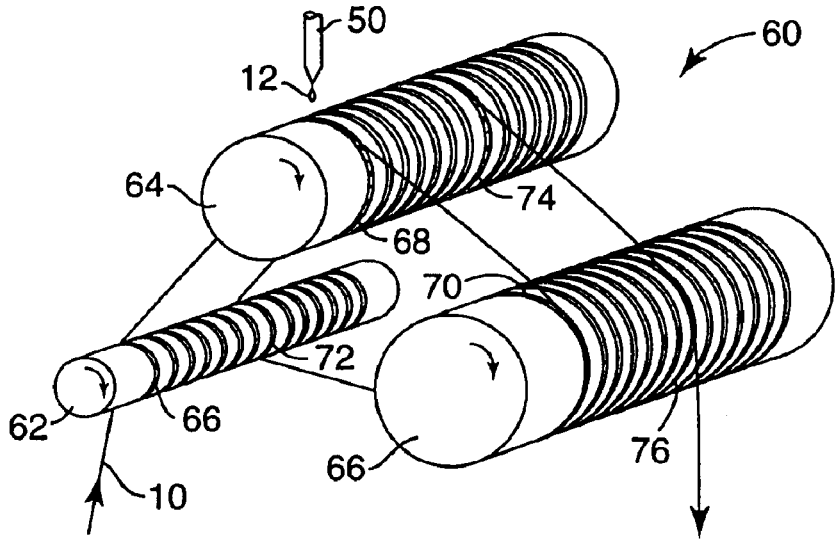
FIG. 4 is a perspective view of a device of the invention that employs a drip applicator and a set of three improvement station rolls wrapped with multiple turns of a filamentous article.

Only two improvement station rolls are shown in FIG. 3. However, more than two such rolls (e.g., 3, 4, 5 or more rolls) can be employed. For example, FIG. 4 is a perspective view of a device 60 having three improvement rolls 62, 64 and 66 in a triangular array. For the device setup shown in FIG. 4, two wraps of strand 10 about rolls 62, 64 and 66 have been employed, for a total of two contact regions on each roll and six contact regions throughout device 60. Groove 66 on Roll 62 serves merely to guide strand 10 toward roll 64, and remains dry. Drip applicator 50 applies coating liquid 12 in groove 68 of roll 64, and accordingly groove 68 is the first wet groove in device 60. After leaving groove 68, strand 10 contacts groove 70 on roll 66, groove 72 on roll 62, groove 74 on roll 64 and groove 76 on roll 66, for a total of five wet contact regions throughout device 60. Rolls 62, 64 and 66 each have different diameters. If the periods of rolls 62, 64 and 66 are chosen appropriately, then device 60 can produce a uniform coating using fewer overall roll contact regions than device 30 of FIG. 3.

Figure 5:
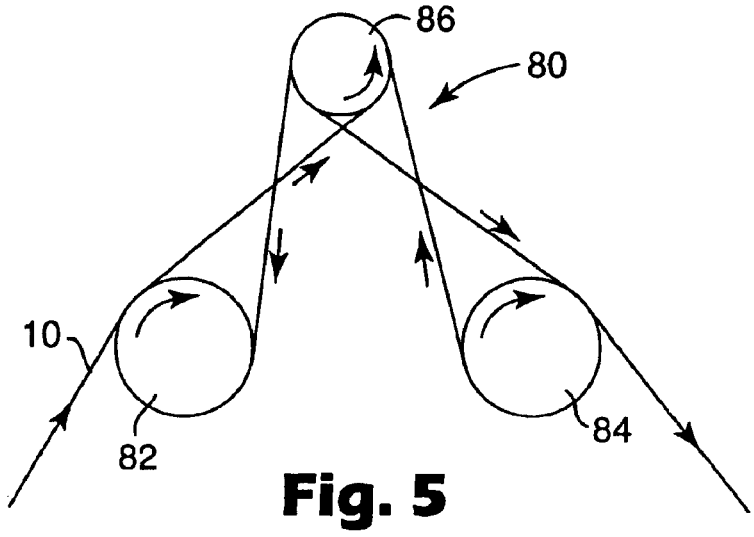
FIG. 5 is a schematic side view of a device of the invention that employs a drip applicator and a set of three improvement station rolls wrapped in a crossed pattern with multiple turns of a filamentous article.

FIG. 5 is a side view of a device 80 of the invention having two equal size improvement rolls 82 and 84 and a smaller diameter roll 86. Strand 10 is threaded over rolls 82, 86 and 84 in a crossed pattern, making two or more wraps over each of rolls 82 and 86 and seven or more contacts with device 80 before exiting the device.

Figure 6:
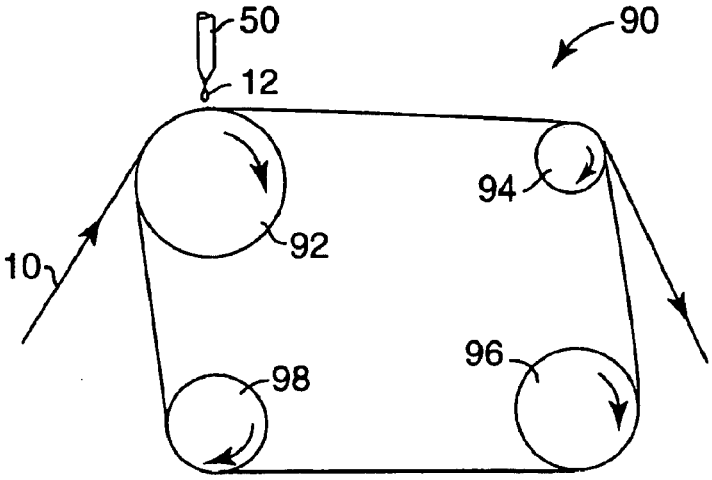
FIG. 6 is a schematic side view of a device of the invention that employs a drip applicator and a set of four improvement station rolls wrapped with multiple turns of a filamentous article.

FIG. 6 is a side view of a device 90 of the invention having four improvement rolls 92, 94, 96 and 98 in a quadrilateral array. Drip applicator 50 applies coating liquid 12 into the first groove (not shown in FIG. 6) of roll 92, whereupon a substantially uneven coating is applied to strand 10. After leaving roll 92, strand 10 wraps around rolls 94, 96 and 98 before returning to roll 92. Strand 10 makes one or more wraps around device 90 and exits device 90 at roll 94.

Figure 7:
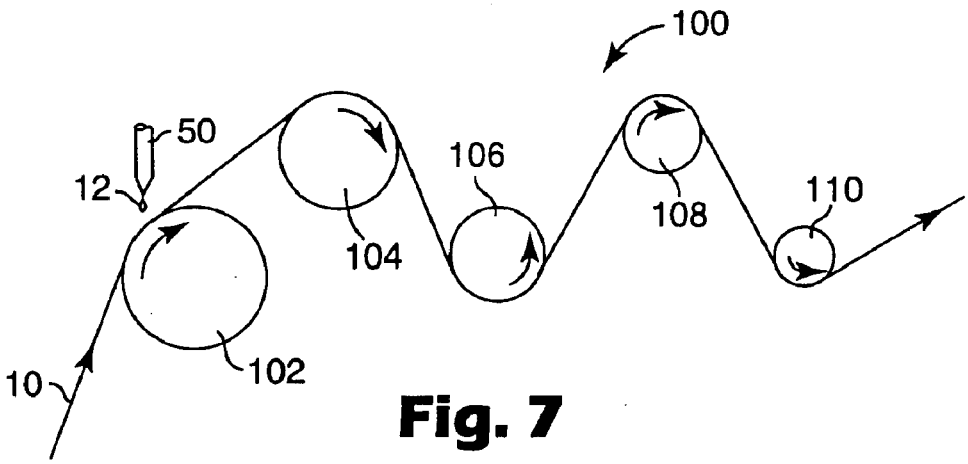
FIG. 7 is a schematic side view of a device of the invention that employs a train of five improvement station rolls wrapped with single partial turns of a filamentous article.

FIG. 7 is a side view of a device 100 of the invention having five improvement rolls 102, 104, 106, 108 and 110 arrayed in a train. Drip applicator 50 applies coating liquid 12 into the first groove (not shown in FIG. 7) of roll 102, whereupon a substantially uneven coating is applied to strand 10. After leaving roll 102, strand 10 wraps around rolls 104, 106, 108 and 110 and exits device 100 at roll 110.

If desired, very large numbers of rolls or roll contacts can be employed. For example, the strand can make as many as 10, 20, 30, 40 or even 100 or more roll contacts before exiting the improvement station. However, for any of the devices of the invention, coating liquid behaviors such as drying, curing, gelation, crystallization or a phase change occurring with the passage of time may impose limitations. If the coating liquid contains a volatile component, the time necessary to achieve hundreds or thousands of roll contacts may allow drying to proceed to an extent that the liquid may solidify. A phase change for any reason while the rolls are in contact with the strand usually results in disruptions and patterns in the applied coating. Therefore, it is generally preferable to produce the desired degree of coating uniformity using as few roll contacts as possible, and for each of the rolls in the improvement station to be wet over its strand-contacting surfaces with coating. It is also preferable to employ unheated rolls, although heated rolls can be utilized if desired. Those skilled in the art will also appreciate that the strand can be heated or cooled if desired prior to application of the substantially uneven coating.

Preferably the roll contacts take place in grooves or other recesses formed in the face of the roll. Use of such grooves is not required, but is preferred for operation of the devices of the invention at higher speeds. Thus preferably at least one of the rolls in a device of the invention is grooved. If desired, the grooves can be treated (e.g., so that the grooves will be wet more easily with the coating liquid) to assist in forming the desired coating. Suitable treatments include roughening the surface of the groove, applying a high surface energy coating, and other techniques that will be apparent to those skilled in the art.

The periods of rotation of the rolls preferably are chosen so that their actions do not reinforce coating defects on the strand. The period of a rotating roll can be expressed in terms of the time required for the roll to pick up a portion of wet coating from one position along a strand and then lay it down on another position, or by the distance along the strand between two consecutive contacts by a surface portion of the roll to the strand. If the strand wraps part way around the roll, the time required is the time for the roll to rotate between the liquid split or lift off point and the entry or lay-on point. For example, if roll 26 in FIG. 3*a* is rotated at 60 rpm and the distance from the liquid split point 54 to the entry point 52 is ⅝ths of the circumference of roll 26 and the relative motion of strand 10 with respect to roll 26 remains constant, then the period of roll 26 is ⅝ths of a second. The devices of the invention employ a plurality of such rotating rolls, preferably having two or more, and more preferably three or more different periods. By using a suitable number of rolls and appropriately selecting their periods of contact with the strand, extremely uniform coatings can be obtained at extremely high rates of speed. Most preferably, pairs of such periods are not related as integer multiples of one another.

The period of a rotating roll can be altered in many ways. For example, the period can be altered by changing the speed of rotation; by repeatedly (e.g., continuously) translating the roll along the length of the strand (e.g., up strand or down strand) with respect to its initial spatial position as seen by a fixed observer; by changing the circumferential extent to which the strand wraps around a roll; or by changing the translational speed of the strand relative to the speed of rotation of a rotating roll. The period does not need to be a smoothly varying function, and does not need to remain constant over time.

Figure 8:
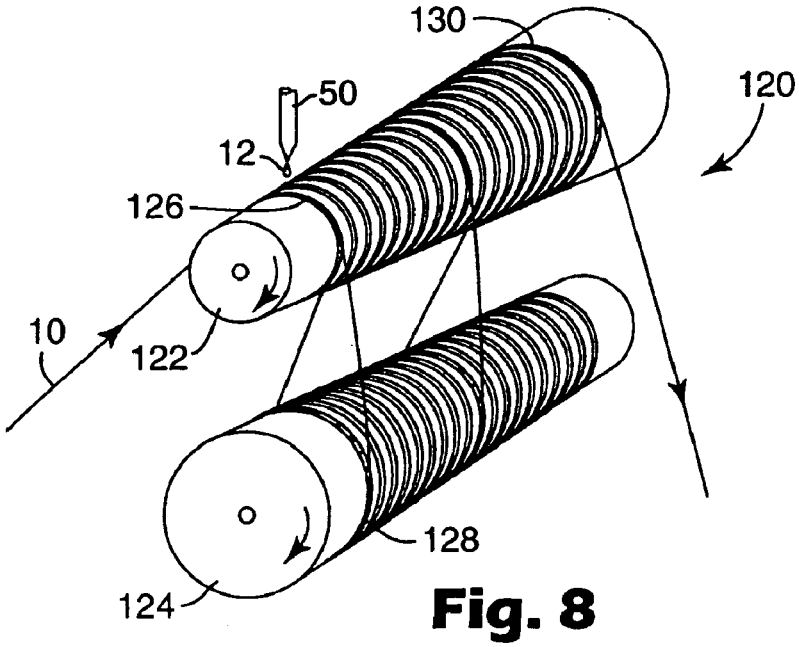
FIG. 8 is a perspective view of a device of the invention having two opposed grooved conical improvement rolls.

FIG. 8 is a perspective view of a device 120 of the invention having two opposed grooved conical improvement rolls 122 and 124. Drip applicator 50 applies coating liquid 12 into groove 126 near the small-diameter end of roll 122, whereupon a substantially uneven coating is applied to strand 10. After leaving roll 122, strand 10 wraps around groove 128 near the large-diameter end of roll 124, then makes a total of two further turns around roll 122 and one further turn around roll 124 before exiting device 120 at groove 130 on roll 122. The use of opposed conical rolls provides a series of different roll contact periods along the length of rolls 122 and 124.

Figure 9:
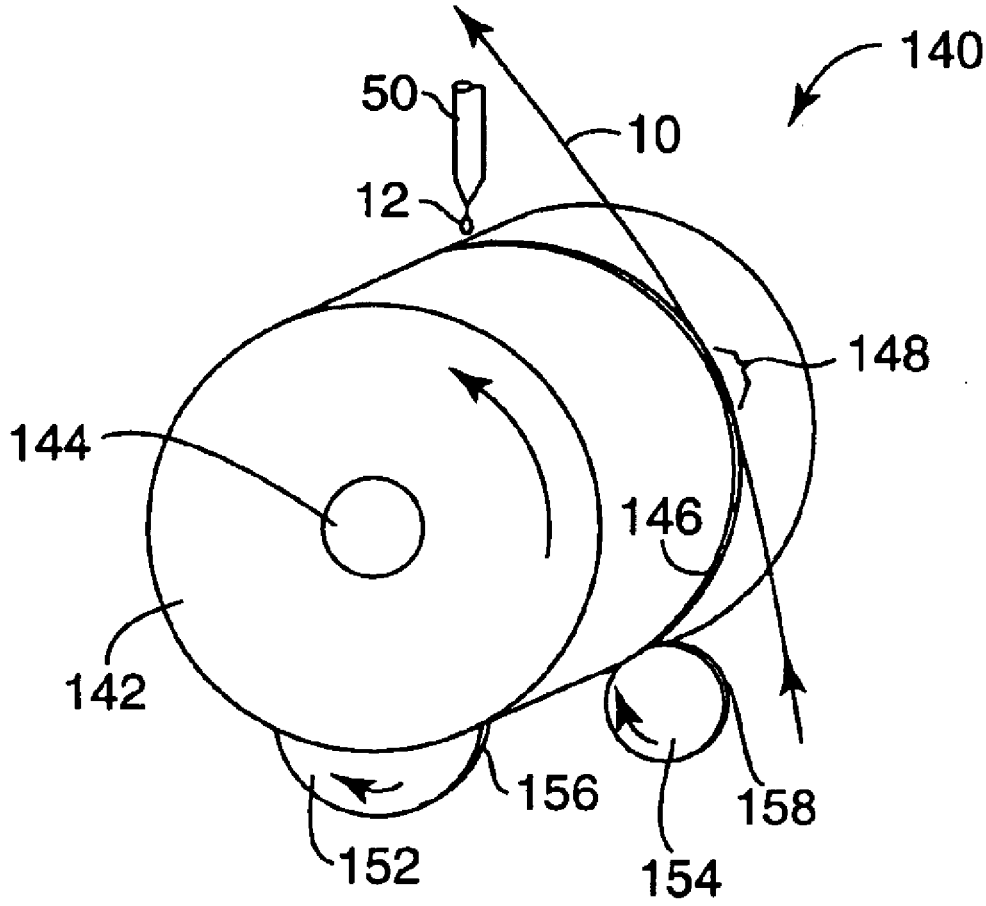
FIG. 9 is a perspective view of a device of the invention employing a transfer roll.

FIG. 9 is a perspective view of a device 140 of the invention having a grooved roll 142 that rotates about axis 144. Drip applicator 50 applies coating liquid 12 into groove 146 in the face of roll 142, whereupon a substantially uneven coating forms in groove 146. The perimeters 156 and 158 of disks 152 and 154 bear against the bottom and sides of groove 146. Disks 152 and 154 serve as pick-and-place devices that improve the uniformity of the coating in groove 146. Disks 152 and 154 can be mounted on shafts (not shown in FIG. 9) and can rotate with the rotation of roll 142. Strand 10 wraps partly around roll 142, contacting groove 146 in region 148. Following startup and operation of device 140 for a few revolutions of roll 142, groove 146 will become evenly wetted with a thin layer of coating liquid at region 148. Some of the coating will transfer to strand 10 in region 148 and will remain on strand 10 as it lifts away from roll 142. Although initially applied only to one side of strand 10, due to capillary forces and surface energy considerations the transferred coating liquid will quickly rearrange itself circumferentially around strand 10, covering all of strand 10 with a thin, uniform void-free coating.

Those skilled in the art will recognize that more than 2 (e.g., 3, 4, 5 or even 20 or more) contacting disks can be used in a device such as device 140. The disks preferably have different periods of contact and preferably those periods are not fractionally related to one another. However, if desired disks having equal or fractionally related periods can be employed, with the caveat that more disks will usually be required in such devices to obtain a result comparable to that obtained using disks whose periods are not fractionally related to one another.

Figure 10:
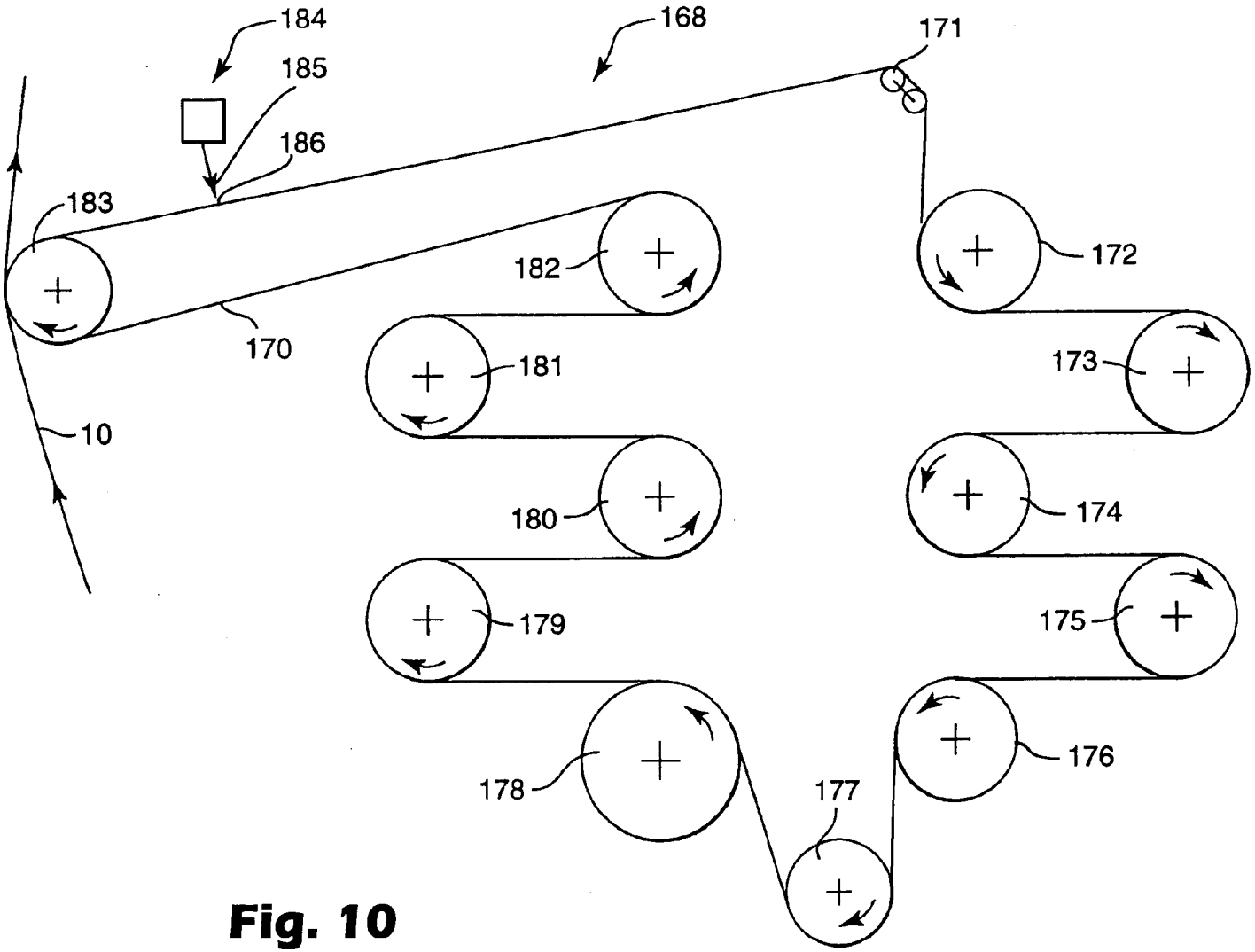
FIG. 10 is a schematic side view of a pick-and-place device employing a transfer belt.

FIG. 10 shows a coating apparatus of the invention 168 employing a transfer belt 170. Belt 170 circulates on steering unit 171; idlers 173, 175, 177, 179, and 181; undriven co-rotating pick-and-place rolls 172, 174, 176, 178, 180 and 182 and back-up roll 183. Rolls 172, 174, 176, 180 and 182 are all the same size and have the same period. Roll 178 is larger than the other pick-and-place rolls and has a much longer period. Improvement station 168 thus contains five pick-and-place contacting devices having substantially the same contact period. Coating station 184 applies drops of coating liquid through hypodermic needle 185 onto the center of belt 170 at stripe coating region 186. The applied drops form a substantially uneven pattern of stripes downstream from station 184. Following startup of the equipment and a few rotations of belt 170, the central lane on belt 170 will widen and become wet along its entire length with coating liquid. If the speed of the belt and the drop delivery period and drop volume are held constant, then to a fixed observer viewing a point atop belt 170 just down belt from region 186, the coating caliper in the lane will exhibit periodic, transient, random, repeating, or transient repeating components in the belt length direction. In any event, when viewed from such a vantage point the coating will be very uneven.

As belt 170 circulates, the coating liquid on belt 170 contacts the surfaces of pick-and-place rolls 172, 174, 176, 178, 180 and 182. Following startup of the equipment and a few rotations of belt 170, the coating liquid will form wet central lanes on the surfaces of pick-and-place rolls 172, 174, 176, 178, 180 and 182. The liquid coating splits at the lift off points of the nip regions where belt 170 contacts pick-and-place rolls 172, 174, 176, 178, 180 and 182. A portion of the coating remains on the pick-and-place rolls 172, 174, 176, 178, 180 and 182 as they rotate away from the lift off points. The remainder of the coating travels onward with belt 170. Variations in the coating caliper just prior to the lift-off points will be proportionally mirrored in both the liquid caliper variation on belt 170 and on the surfaces of the pick-and-place rolls 172, 174, 176, 178, 180 and 182 after they leave the lift off points. Following further movement of belt 170, the liquid on the pick-and-place rolls 172, 174, 176, 178, 180 and 182 will be re-deposited on belt 170 in new positions along belt 170.

Coating is transferred from the wet lane on belt 170 to strand 10 by bringing strand 10 into contact with belt 170 as belt 170 circulates around back-up roll 183. As with device 140 in FIG. 9, the transferred coating liquid quickly rearranges itself circumferentially around strand 10. The transferred coating can be extremely thin, very uniform in thickness and entirely or substantially void-free.

When using a device such as device 168 to continuously coat a strand such as strand 10, liquid is preferably added to belt 170 at region 186 at a rate sufficient to permit its continuous removal at the nip point between roll 183 and strand 10. Because following startup belt 170 will already be coated with liquid, there will not be a three phase (air, coating liquid and belt) wetting line at stripe coating region 186. This makes application of the coating liquid much easier than is the case for direct coating of a dry belt. Since only about one half the liquid is transferred at the 183, 10 nip, the percentage of caliper non-uniformity downstream from region 186 will generally be much smaller (e.g., by as much as much as half an order of magnitude) than when stripe coating a dry strand without a transfer belt and passing the thus-coated strand through an improvement station of the invention having the same number of rolls.

When stripe coating a transfer belt as described above, the period and number of pick-and-place rolls preferably is chosen to accommodate the largest spacing between any two adjacent, down belt stripe deposits. A significant advantage of stripe coating is that it is often easy to produce heavy coating stripes on a belt or other target substrate but difficult to produce thin, uniform and continuous coatings. Another important attribute of such a method is that it has pre-metering characteristics, in that coating caliper can be controlled or otherwise altered by metering or otherwise adjusting the amount of liquid applied to the belt or other target substrate.

Although a speed differential can be employed between belt 170 and any of the other rolls shown in FIG. 10, or between belt 170 and strand 10, preferably no speed differential is employed between belt 170 and pick-and-place rolls 172, 174, 176, 178, 180 and 182, or between belt 170 and strand 10. This simplifies the mechanical construction of device 168.

As shown in some of the embodiments discussed above, the rolls used in the devices of the invention do not have to have different periods. As also shown, the invention can employ rolls having the same or substantially the same placement periods, that is, rolls whose placement periods are the same or are similar to a desired degree of precision. That desired degree of precision will vary depending on the overall number of roll contacts and upon the desired coating caliper uniformity. In general, the more roll contacts employed, the better the results obtained at a given degree of precision in placement periods. For example, the periods can be within ±0.01%, ±0.05%, ±0.1%, ±0.5% or ±1% of one another, with greater precision (e.g., ±0.05%) in the periods of a large number of roll contacts providing results that will in general correspond to those obtainable using less precision (e.g., ±0.5%) in the periods of a smaller number of roll contacts. Thus when a discontinuous or deliberately uneven coating is initially applied to the strand or to a rotating substrate, a suitably large number of equal or substantially equal period roll contacts (e.g., generally 15, 20 or 30 or more roll contacts) may be employed to achieve a uniform caliper coating.

Preferably the period of the coating discontinuity or unevenness is selected or controlled to provide a uniform coating following passage past the rolls of the improvement station. For example, when applying a coating of stripes, then it is preferred to control or select the stripe width, or both the stripe width and stripe period, or each of the stripe width, stripe period and roll period in order to obtain the desired degree of caliper uniformity in the final coating.

A random severe initial defect (e.g., a large coating surge, or a complete absence of coating) can be significantly diminished by an improvement station of the invention. The input defects can be diminished to such an extent that they are no longer objectionable. By using the methods and devices of the invention, a new down strand coating profile can be created at the exit from the improvement station. That is, by using multiple rolls, the multiple defect images that are propagated and repropagated by contact with the first roll are modified by additional multiple defect images that are propagated and repropagated by a further contact or contacts with the second and any subsequent rolls of the improvement station. This can occur in a constructively and destructively additive manner so that the net result is a more uniform coating thickness or a controlled thickness variation. In effect, multiple waveforms are added together in a manner so that the constructive and destructive addition of each waveform combines to produce a desired degree of uniformity. Viewed somewhat differently, when a coating upset passes through the improvement station a portion of the coating from the high spots is in effect picked off and placed back down in lower spots.

The improvement rolls can rotate at the same peripheral speed as the strand, or at a lesser or greater speed. If desired, one or more of the rolls can rotate in a direction opposite to the motion of the strand. In general, it will be preferred to operate the devices of the invention without significant slippage between the strand and the improvement station rolls or other substrates with which the strand may come in contact. Excessive slippage between the strand and a substrate could cause stretching or distortion of the strand. Thus all the rolls preferably rotate in the same direction as and at substantially the same speed as the strand. This can conveniently be accomplished by using co-rotating undriven grooved or ungrooved rolls or transfer substrates that bear against the strand and are carried with the strand in its motion.

If care is taken to avoid strand stretching or distortion, then a further improvement in coating uniformity might be obtained by operating the rolls or transfer substrate at slightly varied speeds using a periodic or random speed differential. Speed variation could be accomplished, for example, by independently driving the rolls with separate motors and electrically varying the motor speeds. Those skilled in the art will appreciate that a variety of mechanical speed variation devices could also be employed, including variable speed transmissions, belt and pulley or gear chain and sprocket systems in which a pulley or sprocket diameter is changed, and limited slip clutches or braking to slow the period of rotation. Other techniques for varying the rotational period of the surface of a rotating body relative to another rotating body include varying the size of the first body while holding its surface speed constant (e.g., by inflating or deflating or otherwise expanding or shrinking a roll). If the rolls are constructed from a thermally expanding material, then the roll sizes (and the roll periods) could also be modified by operating the rolls at differing temperatures. Also, the position of a roll could be varied during operation. All of the above variations may be useful, and all might be used to affect and improve the performance of the devices and methods of the invention and the thickness uniformity of the finished coating. A variety of speed variation functions could be employed, e.g., random or controlled variations, including variations having a periodic (e.g., sinusoidal) or non-periodic nature, random walks, linear ramp functions in time and intermittent changes. All might be used to lessen the number of rolls or roll revolutions required to produce uniform coatings on strands. Very small variations in the roll periods of rotation or surface speeds may be especially useful.

In general, it will be preferred to align the axes of the various improvement station rollers so that they are parallel. If desired, however, one or more of the improvement roller axes can be skewed with respect to other roll axes in the improvement station. By skewing the axes, a degree of twist can be imparted to the strand. If this is done without inducing undesirable distortion of the strand, the result may be an improvement in coating uniformity in fewer roll contacts.

In most instances it will be desirable to harden the finished coating before the strand is rolled up or used for other purposes. Hardening can be accomplished in a variety of ways, including air-drying, radiant heat sources, heated rollers, UV or E-beam cure, and other techniques that will be familiar to those skilled in the art.

The benefits of the present invention can be tested experimentally or simulated for each particular application. Many criteria can be applied to measure coating uniformity improvement. Examples include coating thickness standard deviation, ratio of minimum (or maximum) coating thickness divided by average coating thickness, range (defined as the maximum coating thickness minus the minimum coating thickness over time at a fixed observation point), and reduction in void area. For example, through the use of the present invention, range reductions of greater than 75%, greater than 80%, greater than 85% or even greater than 99% can be obtained. For discontinuous coatings (or in other words, coatings that initially have voids), the invention enables reductions in the total void area of greater than 50%, greater than 75%, greater than 90% or even greater than 99%. Preferably the application of the methods of the invention produces a void-free coating. Those skilled in the art will recognize that the desired degree of coating uniformity improvement will depend on many factors including the type of coating, coating equipment and coating conditions, and the intended use for the coated strand.

Through the use of the invention, 100% solids coating compositions can be converted to void-free or substantially void-free cured coatings with very low average thicknesses, e.g., from about 0.1 to about 100 micrometers, from about 1 to about 10 micrometers or from about 1 to about 5 micrometers.

The methods and devices of the invention can be used to apply, make more uniform or dry coatings on a variety of strands, including strands made of plastic, glass, metal, metal alloys or composite materials. The strands can have a variety of surface topographies including smooth, textured, patterned, microstructured and porous surfaces. The strands can have one or more layers of coating, and one layer or many layers of strand material under the coating layer. The strands can have a variety of uses, including transmission of light, electrical current or data (e.g., optical fibers); filtration; membranes (e.g., fuel cell membranes); sound or thermal insulation; electronic device fabrication; reinforcing fibers and the like.

The coatings can be made from many suitable materials including a wide variety of monomers, polymers and mixtures thereof, and a wide variety of molten metals such as tin, zinc, copper, palladium, nickel or aluminum and alloys thereof. The coatings and coated strands can have many purposes (including insulation, conduction, protection against abrasion, lubrication, composite reinforcement, strand identification, or light management). For example, suitable composite reinforcement purposes include the formation of alkali resistant coatings on reinforcing fibers for cement or composites. Suitable light management purposes include imparting transparency, refraction, reflection or color to the coating, such as the formation of glass/high refractive index/low refractive index clad optical fibers as described in U.S. Pat. No. 4,877,306 or the formation of glass/silicon/polyamide optical fibers.

The various embodiments of the invention are especially useful for making 100% solids coatings, precision coatings and extremely thin coatings on strands.

The invention is further illustrated in the following examples, in which all parts and percentages are by weight unless otherwise indicated.

EXAMPLE 1

The device of FIG. 3 was used to form a thin liquid coating on a plastic strand. Rolls 26 and 32 of the device were rubber-covered rolls with respective diameters of 56.57 mm and 62.33 mm. A set of 47 grooves having widths of 0.84 mm and depths of 1.65 mm were machined 7 mm apart into the face of each roll. A coating liquid was prepared by combining 65 parts glycerol, 30 parts water, 0.25 parts by volume of a fluorochemical wetting agent (3M™ FLUORAD™ FC-129 fluorosurfactant, Minnesota Mining and Manufacturing Company, St. Paul, Minn.) and 2.05 parts of a saturated water solution of an optical brightener (TINAPOL™ SFP from Ciba Performance Chemicals of Hawthorne, N.Y.). A strand of monofilament fishing line (No. M-1460 60LB test line, South Bend Sporting Goods, Northbrook, Ill.) with a diameter of 0.76 mm was wrapped 13 times around the device of FIG. 3 by placing the strand into neighboring grooves near the center of rolls 26 and 32.

Using a powered take up reel, the strand was transported through the device at 5 meters per minute. Using a 10 cc syringe and a Harvard Syringe Pump (Model 55-1144 from Harvard Apparatus, South Natich, Mass.), the coating liquid was dripped into the first filled groove of roll 26 at a feed rate of 0.027 cc/min. Following passage through the improvement station, the very discontinuous initially applied coating was transformed to a void-free continuous coating with excellent thickness uniformity of approximately 2 micrometers. The improvement in the coating uniformity could be seen by shining a Model UVGL-25 lamp (UVP, Inc of San Gabriel, Calif.) onto the device and visibly inspecting the wet coated strand before and after each groove. The strand became more and more uniform in appearance as it passed through the device and appeared to be continuous, void free, and uniform as it exited the device.

EXAMPLE 2

Using the method of Example 1, the flow rate was reduced to 0.005 cc/min. This resulted in the deposition of 0.001 cc of coating liquid per meter of strand length. Upon exiting the device, the coating was continuous and uniform when observed under black light.

EXAMPLE 3

Using the method of Example 1, the strand was wrapped 26 times around rolls 26 and 32 and the coating liquid flow rate was reduced to 0.0025 cc/min. This resulted in the deposition of 0.0005 cc of coating liquid per meter of strand length. Upon exiting the device, the coating was continuous and uniform when observed under black light.

EXAMPLE 4

The rolls used in Examples 1–3 were installed in the device of FIG. 6. The remaining two device rolls had respective diameters of 69.01 mm and 56.62 mm and were grooved like the rolls used in Examples 1–3. The monofilament line was wrapped 34 times around the rolls. The coating liquid flow rate was adjusted to 0.0065 cc/min. This resulted in the deposition of 0.0013 cc of coating liquid per meter of strand length. Upon exiting the device, the coating was continuous and uniform when observed under black light.

EXAMPLE 5

Using the method of Example 4, the coating liquid flow rate was reduced to 0.0019 cc/min. This resulted in the deposition of only 0.00026 cc of coating liquid per meter of strand length. Upon exiting the device, the coating was continuous but visibly non-uniform when observed under black light. A higher coating liquid deposition rate, use of more wraps or suitable adjustment of the relative diameters of the improvement station rolls would provide a further improvement in coating uniformity.

Various modifications and alterations of this invention will be apparent to those skilled in the art without departing from the scope and spirit of this invention. This invention should not be restricted to that which has been set forth herein only for illustrative purposes.

What is claimed is:

1. A device comprising a coating station having a non-uniform applicator that directly or indirectly applies a substantially uneven coating to at least some of the exposed portion of a filamentous article such that along a 1 meter length of the article the coating has voids or low spots whose minimum thickness is less than one-half the average coating thickness along that length, and an improvement station comprising two or more rotating rolls that periodically contact and re-contact the wet coating at different positions along the length of the filamentous article, wherein the number or periods of the rolls improve the uniformity of the coating.

2. A device according to claim 1 wherein the coating station drips the coating liquid onto the filamentous article or onto a roll.

3. A device according to claim 1 wherein the coating station sprays the coating liquid onto the filamentous article or onto a roll.

4. A device according to claim 1 wherein the coating station periodically applies the coating liquid and the application period can be adjusted to improve the uniformity of the coating.

5. A device according to claim 1 comprising at least three rolls.

6. A device according to claim 1 wherein the rolls have the same period of contact with the filamentous article.

7. A device according to claim 1 wherein the rolls do not all have the same period of contact with the filamentous article.

8. A device according to claim 7 wherein the rolls all have different periods of contact with the filamentous article.

9. A device according to claim 7 wherein the rotational periods of the rolls are not periodically related.

10. A device according to claim 7 wherein the filamentous article has at least five contacts with the rolls following application of the substantially uneven coating.

11. A device according to claim 7 wherein the filamentous article has at least eight contacts with the rolls following application of the substantially uneven coating.

12. A device according to claim 1 wherein the filamentous article has at least 13 contacts with the rolls following application of the substantially uneven coating.

13. A device according to claim 1 wherein the filamentous article has a direction of motion and the direction of rotation of at least one of the rolls is the same as the direction of motion.

14. A device according to claim 13 wherein the direction of rotation of at least two of the rolls is the same as the direction of motion.

15. A device according to claim 13 wherein the direction of rotation of all the rolls is the same as the direction of motion.

16. A device according to claim 15 wherein there is substantially no slippage between the rolls and the filamentous article.

17. A device according to claim 1 wherein at least one of the rolls is grooved.

18. A device according to claim 1 wherein all of the rolls are grooved.

19. A device according to claim 1 wherein a voided coating is applied to the filamentous article and converted by contact with the rolls to a void-free coating.

20. A device according to claim 1 wherein the coating is converted to have an average caliper from 1 to about 10 micrometers.

21. A device according to claim 1 wherein the coating is converted to have an average caliper from 1 to about 5 micrometers.

* * * * *

UNITED STATES PATENT AND TRADEMARK OFFICE

CERTIFICATE OF CORRECTION

PATENT NO. : 6,926,772 B2
DATED : August 9, 2005
INVENTOR(S) : Leonard

It is certified that error appears in the above-identified patent and that said Letters Patent is hereby corrected as shown below:

Column 3,
Line 30, delete “H” and insert -- h --.
Line 32, delete “H” and insert -- H’ --.

Signed and Sealed this

Third Day of January, 2006

JON W. DUDAS
*Director of the United States Patent and Trademark Office*